US008672719B2

(12) United States Patent
Grimes et al.

(10) Patent No.: US 8,672,719 B2
(45) Date of Patent: Mar. 18, 2014

(54) AQUATIC SPORT BOARD

(75) Inventors: Toby Grimes, Miami Gardens, FL (US); Carlos M. Menendez, Weston, FL (US)

(73) Assignee: Recon Paddleboards LLC, Miami, FL (US)

( * ) Notice: Subject to any disclaimer, the term of this patent is extended or adjusted under 35 U.S.C. 154(b) by 33 days.

(21) Appl. No.: 13/206,220

(22) Filed: Aug. 9, 2011

(65) Prior Publication Data

US 2012/0040574 A1 Feb. 16, 2012

Related U.S. Application Data

(60) Provisional application No. 61/372,305, filed on Aug. 10, 2010.

(51) Int. Cl.
*B63B 17/00* (2006.01)
*B63B 35/81* (2006.01)

(52) U.S. Cl.
USPC ..... 441/74; 114/364

(58) Field of Classification Search
USPC ..... 441/65, 74, 75, 76; 114/343, 347, 364
See application file for complete search history.

(56) References Cited

U.S. PATENT DOCUMENTS

| | | | | |
|---|---|---|---|---|
| 2,452,922 | A | 11/1948 | Gonsett et al. | |
| 3,324,488 | A | 6/1967 | Schulz, Jr. | |
| 3,340,845 | A | 9/1967 | Tyrack | |
| 3,548,778 | A | 12/1970 | Von Smagala-Romanoff | |
| 4,043,531 | A * | 8/1977 | Green | 248/537 |
| 4,129,911 | A | 12/1978 | McDonald et al. | |
| 4,194,458 | A | 3/1980 | Messing | |
| 4,507,094 | A | 3/1985 | Hennebutte | |
| 4,571,195 | A * | 2/1986 | Brooks, Jr. | 441/74 |
| D376,150 | S | 12/1996 | Pesce | |
| 5,618,215 | A | 4/1997 | Glydon | |
| 5,894,810 | A | 4/1999 | Orr | |
| 6,112,686 | A | 9/2000 | Tsumiyama et al. | |
| 6,311,631 | B1 * | 11/2001 | Beecher | 114/55.56 |
| 6,722,305 | B2 | 4/2004 | Mizushima | |

(Continued)

FOREIGN PATENT DOCUMENTS

| | | |
|---|---|---|
| GB | 2445049 | 6/2008 |
| JP | 10338191 | 12/1998 |

(Continued)

OTHER PUBLICATIONS

International Search Report and Written Opinion dated Mar. 7, 2012 for PCT/US2011/047086.

*Primary Examiner* — Stephen Avila
*Assistant Examiner* — Andrew Polay
(74) *Attorney, Agent, or Firm* — Fleit Gibbons Gutman Bongini & Bianco PL; Jon A. Gibbons

(57) ABSTRACT

An aquatic sport board includes a top portion and a bottom portion. The bottom portion is coupled to the top portion by a first side portion and a second side potion. The first portion and the second portion taper inward towards a front portion and a rear portion of the top and bottom portions. Recessed areas are situated on the top portion and extend inward towards the bottom portion. A plurality of sections is situated between the top portion and the bottom portion. Each section in the plurality of sections is sealed off from one another.

12 Claims, 7 Drawing Sheets

(56) References Cited

U.S. PATENT DOCUMENTS

| | | | | |
|---|---|---|---|---|
| 6,880,481 | B2 * | 4/2005 | Dunn et al. | 114/347 |
| 7,025,644 | B2 | 4/2006 | Geier et al. | |
| 7,588,474 | B2 | 9/2009 | Taggart | |
| 7,811,144 | B2 | 10/2010 | Cavanaugh | |
| 2002/0136017 | A1 * | 9/2002 | Tufte | 362/477 |
| 2005/0064774 | A1 | 3/2005 | Grune et al. | |
| 2006/0008104 | A1 * | 1/2006 | Sausser | 381/334 |
| 2006/0050903 | A1 * | 3/2006 | Chan | 381/124 |
| 2006/0223394 | A1 | 10/2006 | Porat | |
| 2006/0254495 | A1 * | 11/2006 | Eckert | 114/347 |
| 2011/0056423 | A1 | 3/2011 | Railey | |
| 2011/0114007 | A1 * | 5/2011 | Flemons, III | 114/347 |

FOREIGN PATENT DOCUMENTS

| | | |
|---|---|---|
| JP | 2006312442 | 11/2006 |
| WO | 9742802 | 11/1997 |
| WO | 2007014357 | 2/2007 |
| WO | 2009103989 | 8/2009 |

* cited by examiner

142

AQUATIC SPORT BOARD

CROSS-REFERENCE TO RELATED APPLICATION

This application is based upon and claims priority to U.S. Provisional Patent Application Ser. No. 61/372,305 filed Aug. 10, 2010 the disclosure of which is hereby incorporated by reference in its entirety.

FIELD OF THE INVENTION

The present invention generally relates to aquatic sport boards, and more particularly relates to paddleboards.

BACKGROUND OF THE INVENTION

Aquatic sport boards such as paddleboards have been in existence for many years. A paddleboard comprises the general shape of a surfboard, but is usually much larger in size. Paddleboards allow an individual to either lie down on the board and propel his/herself using a swimming motion or stand/kneel on the board and propel his/herself using a paddle.

SUMMARY OF THE INVENTION

In one embodiment, an aquatic sport board is disclosed. The aquatic sport board comprises a top portion and a bottom portion. The bottom portion is coupled to the top portion by a first side portion and a second side potion. The first portion and the second portion taper inward towards a front portion and a rear portion of the top and bottom portions. Recessed areas are situated on the top portion and extend inward towards the bottom portion. A plurality of sections is situated between the top portion and the bottom portion. Each section in the plurality of sections is sealed off from one another.

In another embodiment, an aquatic sport board comprises a top portion and a bottom portion. The bottom portion is coupled to the top portion by a first side portion and a second side potion. The first and second side portions taper inward toward a front portion and a rear portion of the top and bottom portions. A plurality of recessed areas is situated on the top portion extending inwards toward the bottom portion. At least one power source is disposed in at least one of the recessed areas in the plurality of recessed areas. At least one cavity is disposed within the top portion. At least one of the cavities comprises an electrical contact that is electrically coupled to the power source. At least one audio emitting device is situated in at least the top portion. At least one illuminating device circumscribes at least the first side portion and the second side portion. The at least one illuminating device is electrically coupled to the power source. At least one coupling mechanism is situated on the top portion between a first recessed area in the plurality of recessed areas and the front portion. At least a portion of the at least one coupling mechanism collapses/retracts into the top portion. At least one cavity is disposed on an outer perimeter of the top portion. The at least one cavity is configured to receive at least one coupling member. At least one storage component is coupled to the at least one coupling member and to at least one other coupling member situated within in at least one other cavity disposed on the outer perimeter of the top portion.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one as or more than one. The term plurality, as used herein, is defined as two as or more than two. Plural and singular terms are the same unless expressly stated otherwise. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Aquatic Sport Board

Figure 1:
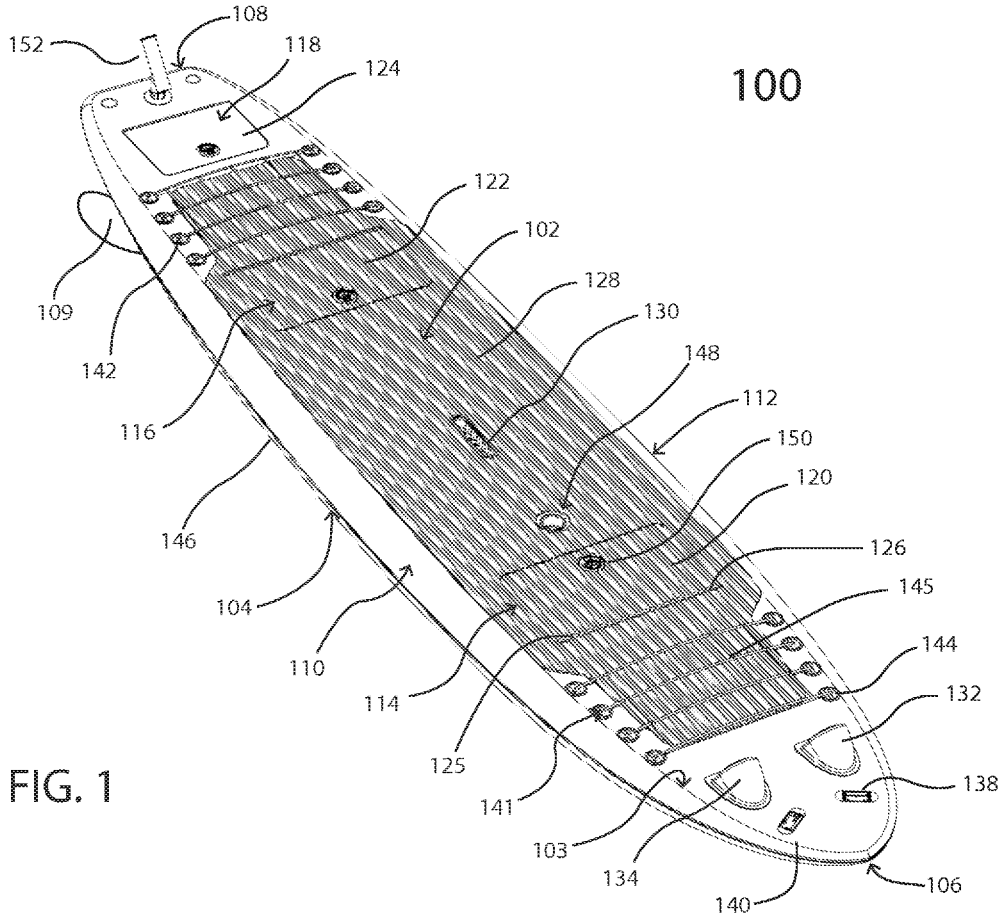
FIG. 1 is a top side view of an aquatic sport board according to one embodiment of the present invention.

FIGS. 1-4 illustrate various examples of an aquatic sport board 100 such as a paddleboard according to one or more embodiments of the present invention. In particular, FIG. 1 shows a top side view of an aquatic sport board 100. The board 100 of FIG. 1 comprises a top portion 102, a bottom portion 104, a front portion 106, a rear portion 108, a first side portion 110, and a second side portion 112. In one embodiment, the first and second side portions 110, 112 taper inward toward the front portion 106 and the rear portion 108. The top portion 102, in one embodiment, is the portion of the board 100 on which the user stands, sits, kneels, etc. Stated differently, the top portion 102 of the board 100 supports the user. The bottom portion 104, in this embodiment, is the portion of the board 100 that faces the water when in use by the user. The front portion 106 and rear portion 108 are situated at opposite ends of the board 100 and are coupled to each other via the side portions 110, 112. The first side portion 110 and the second side portion 112 are situated across from each other and taper inwards towards the front and rear portions 106, 108. One or more stabilizing members 109, in one embodiment, extend outwards from the bottom portion 104 and help stabilize the board 100 in water. In one embodiment, the one or more stabilizing members 109 are situated towards the rear portion 108 of the board 100. However, one or more stabilizing members 109 can be situated anywhere on the bottom portion 104 of the board 100.

In one embodiment, the board 100 comprises one or more recessed areas 114, 116, 118 (shown in more detail in FIGS. 2-4) with optional covering members 120, 122, 124. It should be noted that the number of and location of the recessed areas 114, 116, 118 shown in the figures are only for illustrative purposes and do not limit various embodiments to the number and locations of recessed areas shown. The one or more recessed areas 114, 116, 118 extend from the top portion 102 inward towards the bottom portion 104, as shown in FIGS. 2-5. In one embodiment, one or more of the recessed areas 114, 116, 118 are configured as cargo/storage areas for storing various items such as, but not limited to, a first aid kit, swimming/diving gear, food/beverages, survival gear, personal items, such as wireless communication devices, money, and the like, any other type of items. Also, one or more of the recessed areas 114, 116, 118 can be removable or formed as part of the board 100. The optional covering members 120, 122, 124 are situated on top of (or on an upper area of) the recessed areas 114, 116, 118 and provide a water tight seal to prevent water from entering the recessed areas 114, 116, 118. One or more fastening mechanisms 219 (FIG. 2), such as (but not limited to a lock, latch, pressure fittings, etc.) can be disposed on a portion of recessed areas 114, 116, 118 to securely couple the covering members 120, 122, 124 to the recessed area 114, 116, 118.

One or more of the covering members 120, 122, 124 are pivotably coupled to its recessed area 114, 116, 118 via one or more pivoting members 125, 126 such as, but not limited to a hinge. The pivoting members 125, 126 allow the corresponding covering member 120, 122, 124 to rise off of and lower onto the corresponding recessed area 114, 116, 118. In one embodiment, these pivoting members 125, 126 are hidden. In other words, when a covering member 120, 122, 124 is in a closed position, thereby covering its recessed area 114, 116, 118, the covering member 120, 122, 124 is substantially flush with the top portion 102 of the board 100. The one or more pivoting members 125, 126 can be coupled to an inner portion of the recessed areas 114, 116, 118 and to an underside of the covering member 120, 122, 124 that faces the recessed area 114, 116, 118. In another embodiment, a pivoting member 125, 126 can be coupled to an inner area of the board 100 between the top portion 102 and the bottom portion 104, or to an underside 401 (FIG. 4) of the top portion 102 or an upper side 210 (FIG. 2) of the bottom portion 104. It should be noted that other ways of coupling the pivoting members 125, 126 to the board 100 and the covering members 120, 122, 124 are also applicable as well.

In another embodiment, one or more of the covering members 120, 122, 124 are removably coupled to their recessed areas 114, 116, 118. In this embodiment, the pivoting members 125, 126 are not utilized. However, it should be noted that a covering member 120, 122, 124 utilizing pivoting members 125, 126 can also be removable as well. The covering members 120, 122, 124, in one embodiment, are secured to either a top portion of the recessed area 114, 116, 118, an inner portion of the recessed area 114, 116, 118, or the top portion 102 of the board 100 by any type of fastening mechanism 219 (such as, but not limited to, latches, snaps, magnets, pressure fit, and/or the like) to prevent the covering members 120, 122, 124 from inadvertently allowing access or leakage into the recessed areas 114, 116, 118. Also, a seal/gasket can circumscribe either a bottom face (oriented towards the recessed area 114, 116, 118) of the covering member 120, 122, 124 or a top perimeter (the portion of the recessed area the contacts the covering member) of the recessed area 114, 116, 118. This seal/gasket also helps provide a water tight seal when the covering member 120, 122, 124 is in a closed position.

The covering members 120, 122, 124 can also be configured to partially open and close. In other words, the covering members 120, 122, 124 can be configured to lock/stay at any position between a fully closed position and a fully open position with respect to the recessed areas 114, 116, 118. In one embodiment, the user is able to place an item (e.g., media player, tablet, cellular phone, etc.) on top of a covering member 120, 122, 124 and transition the covering member 120, 122, 124 to an angled position (or vice versa). This allows the user to better view the item while standing, sitting, etc. The covering members 120, 122, 124 can include a friction providing material that prevents the item from slipping off of the covering member 120, 122, 124 when positioned at an angle. The covering members 120, 122, 124 can also include one or more fasteners such as, but not limited to, hook and loop fasteners, magnets, snap fasteners, and the like to retain the item.

The top portion 102 of the board 100 also comprises one or more receiving areas 128 where one or more individuals are able to stand/sit/lay/kneel on the board 100. In one example, the receiving area(s) 128 is one continuous area disposed on the top portion 102 of the board 100 between the front and rear portions 106, 108 of the board 100. In this example, one or more of the recessed areas 114, 116, 118 are situated within the receiving area 128. In another example, the receiving area 128 can be situated on substantially the entire top portion 102 of the board 100. In yet another example, the receiving area is composed of multiple receiving areas. For example, a first receiving area can be situated on the top portion 102 towards the front portion 106 of the board 100 and in front (towards the front portion 106) of a first recessed area 114. A second receiving area (not shown) can be situated behind (towards the rear portion 108) a second recessed area 122 and in front of (towards the front portion 106) a third recessed area 124. However, other configurations are applicable as well. In one embodiment, a first receiving area is smaller in length (where length is oriented from front portion 106 to rear portion 108 and width is oriented from first side portion 110 to second side portion 112) than a second receiving area. Additionally, the first and second receiving areas may also comprise recessed areas similar to the recessed areas 114, 116, 118 discussed above to provide additional storage space. It should be noted these configurations (e.g., locations and sizes) of the recessed areas 114, 116, 118 and the receiving area(s) 128 are only one non-limiting example and other configurations are applicable as well.

Figure 5:
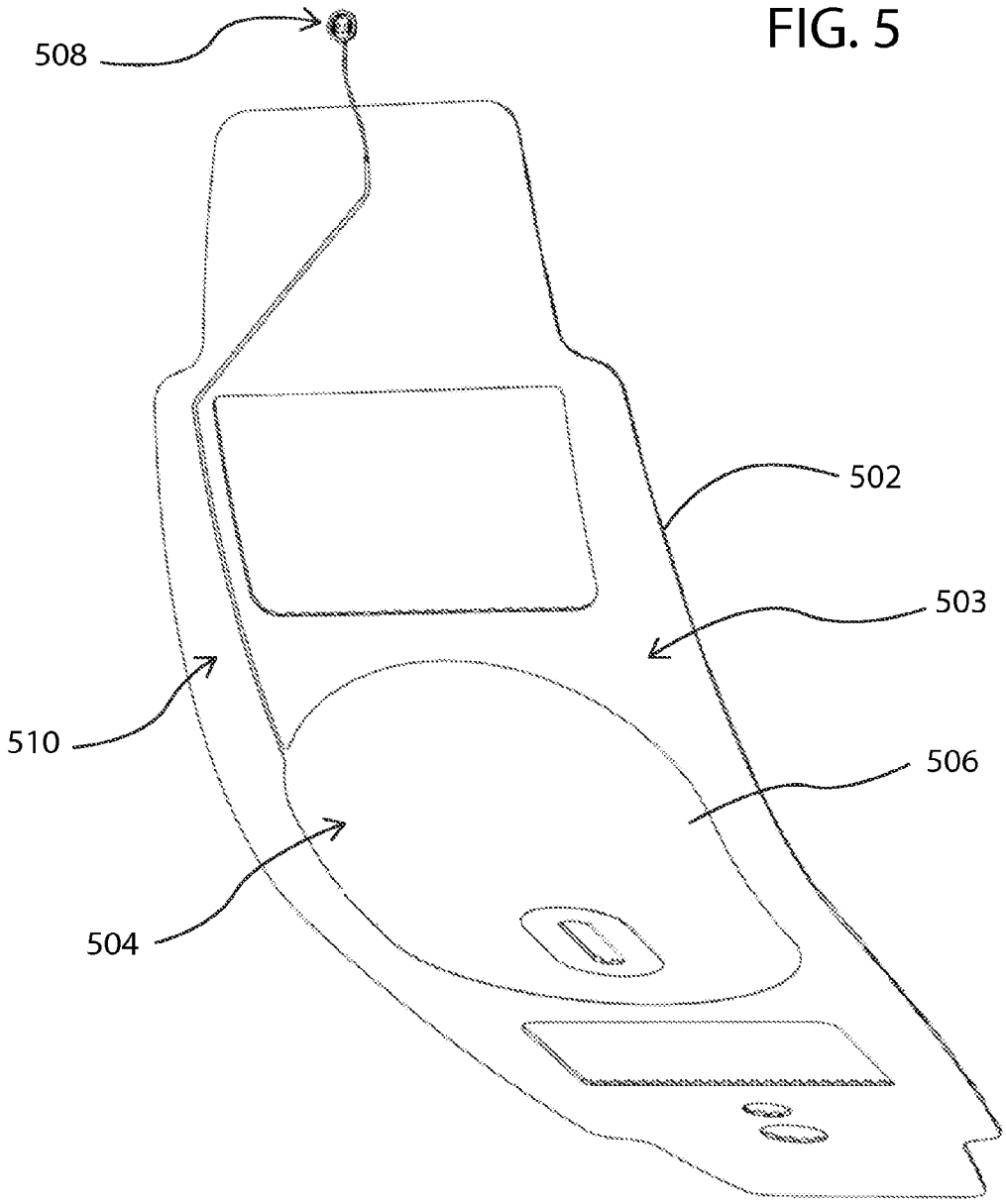
FIG. 5 is a bottom view of a material comprising one or more heating elements that can be disposed on a top portion of the aquatic sport board of FIG. 1 according to one embodiment of the present invention.

The receiving area(s) 128, in one embodiment, is comprised of a cushion and/or friction providing material 502 (FIG. 5). This material provides comfort for the individual(s) and also helps to counteract any type of slippage that may occur from water. In one embodiment, one or more of the covering members 120, 122, 124 also comprise the cushion and/or friction providing material. In another embodiment, one or more regions 504 (FIG. 5) of the cushion and/or friction providing material 502 (FIG. 5) comprise one or more heating components 506 (FIG. 5), which is discussed in greater detail below with respect to FIG. 5.

Figure 2:
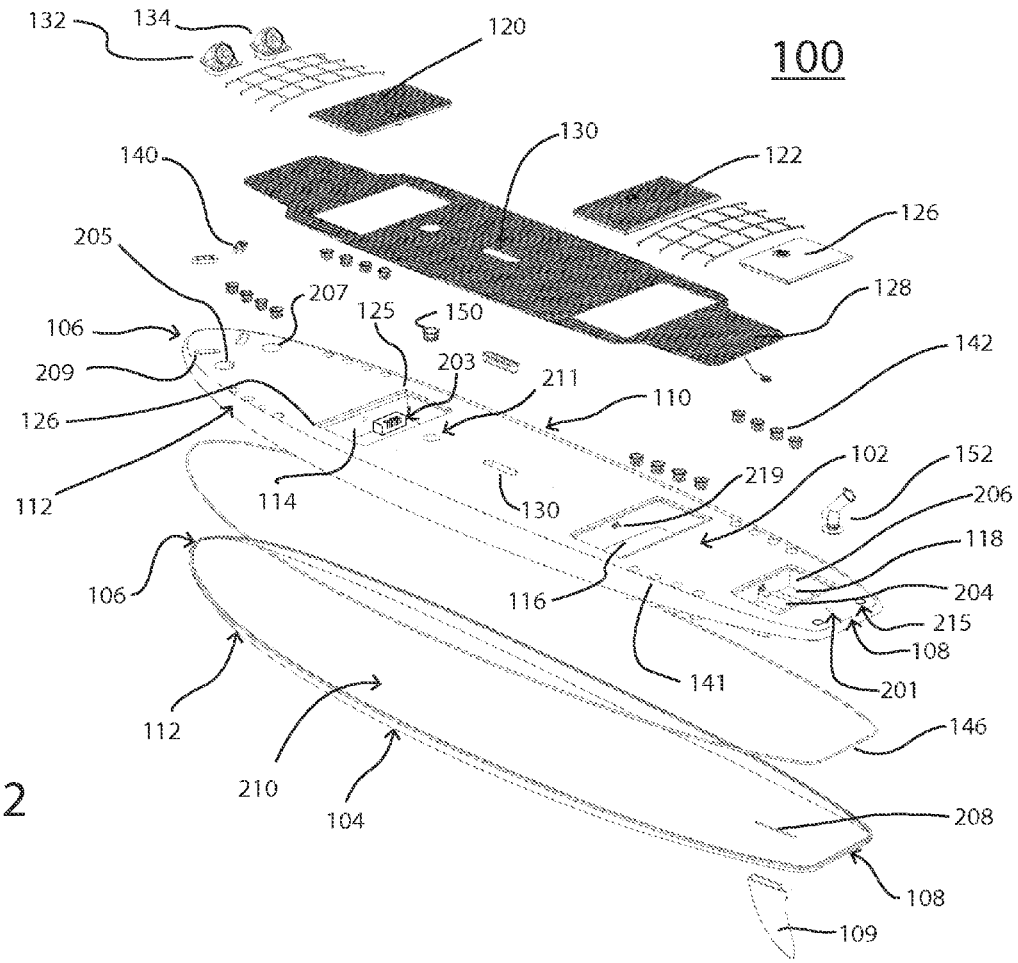
FIG. 2 is top exploded view of the aquatic sport board of FIG. 1 according to one embodiment of the present invention.

In one embodiment, one or more handle members 130 are provided on the board 100. FIGS. 1-2 show a handle member 130 as being situated in the receiving area 128 where the handle member 130 is recessed inward from the top portion 102 towards the bottom portion 104. However, this is only one example, as the handle member(s) 130 can be situated on any of the top, bottom, front, rear, and side portions 102, 104, 106, 108, 110, 112 of the board 100. Also, the handle member 130 is not required to be recessed. For example, the handle member 130 can also extend outwards from the board 100 as well.

In addition, the handle member 130 can comprise molded areas that contour a user's fingers. In one embodiment, the handle member 130 comprises a retractable member (not shown) that rests substantially flush with the top portion 102 of the board when in a resting position (i.e., not being pressed down by a user when carrying the board 100). In this example, as the user inserts his/her fingers or hand into the handle member 130 the retractable member retracts inward into the recessed area of the handle member 130. As the user removes his/her hand from the handle member 130 the retractable member automatically transitions back towards the top portion 102 of the board 100. The retractable member can comprise various energy storing components such as (but not limited to) springs, elastics, etc. that provide the retracting capability of the member.

The board 100, in one embodiment, also comprises one or more audio devices 132, 134. For example, FIG. 1 shows one or more audio devices 132, 134 such as speakers situated towards the front portion 106 of the board 100 in front of the first recessed area 114 (e.g., in between the recessed area 114 and the front portion 106 of the board 100). However, the audio devices 132, 134 can be situated anywhere on the board 100. In one embodiment, the audio devices 132, 134 extend above the top portion 102 of the board 100 and can be rotated/turned as desired by the user. Alternatively, the audio devices 132, 134 are substantially flush (or recessed) with the top surface 102. The audio devices 132, 134 can also be retractable such that when in one position they extend above the top portion 102 of the board 100 and in another position they are substantially flush (or below) with the top portion 102 of the board 100. The audio devices 132, 134, in one embodiment, are disposed within corresponding recessed areas 205, 207, as shown in FIG. 2. It should be noted that the audio devices 132, 134, in one embodiment, are waterproof and/or are encapsulated in a waterproof housing. Also, the audio devices 132, 134 can be removable and/or wireless and can be coupled to one or more devices.

One or more coupling mechanisms 138, 140 such as, but not limited to hooks, loops, magnets, hook and loop fasteners, and/or the like are situated on the top portion 102 (or any of the other portions 104, 106, 108, 110, 112) of the board 100. These coupling mechanisms 138, 140 can be collapsible/retractable such that a user can collapse/retract them into the board 100 when not in use. In one embodiment, when the coupling mechanisms 138, 140 are in a collapsed/retracted state they are substantially flush with the top portion 102 of the board 100. In one embodiment, the coupling mechanisms 138, 140 comprise a base portion (not shown) that extends into the top portion 102 of the board 102. A coupling member (not shown) is pivotably coupled to the base portion such that the user can rotate the coupling member upward (away from the bottom portion 104 of the board 100) so that one or more items can be coupled thereto. When not in use, the coupling member can be rotated downward (towards the bottom portion 104 of the board 100) so that the coupling member is substantially flush with the top portion 102 of the board 100. It should be noted that the coupling mechanism(s) 138, 140 can be removably coupled to a receiving area 209 (FIG. 2) (e.g., cavity) within the top portion 102 of the board 100 so that the user can dynamically configure the location of the coupling mechanisms 138, 140.

Figure 3:
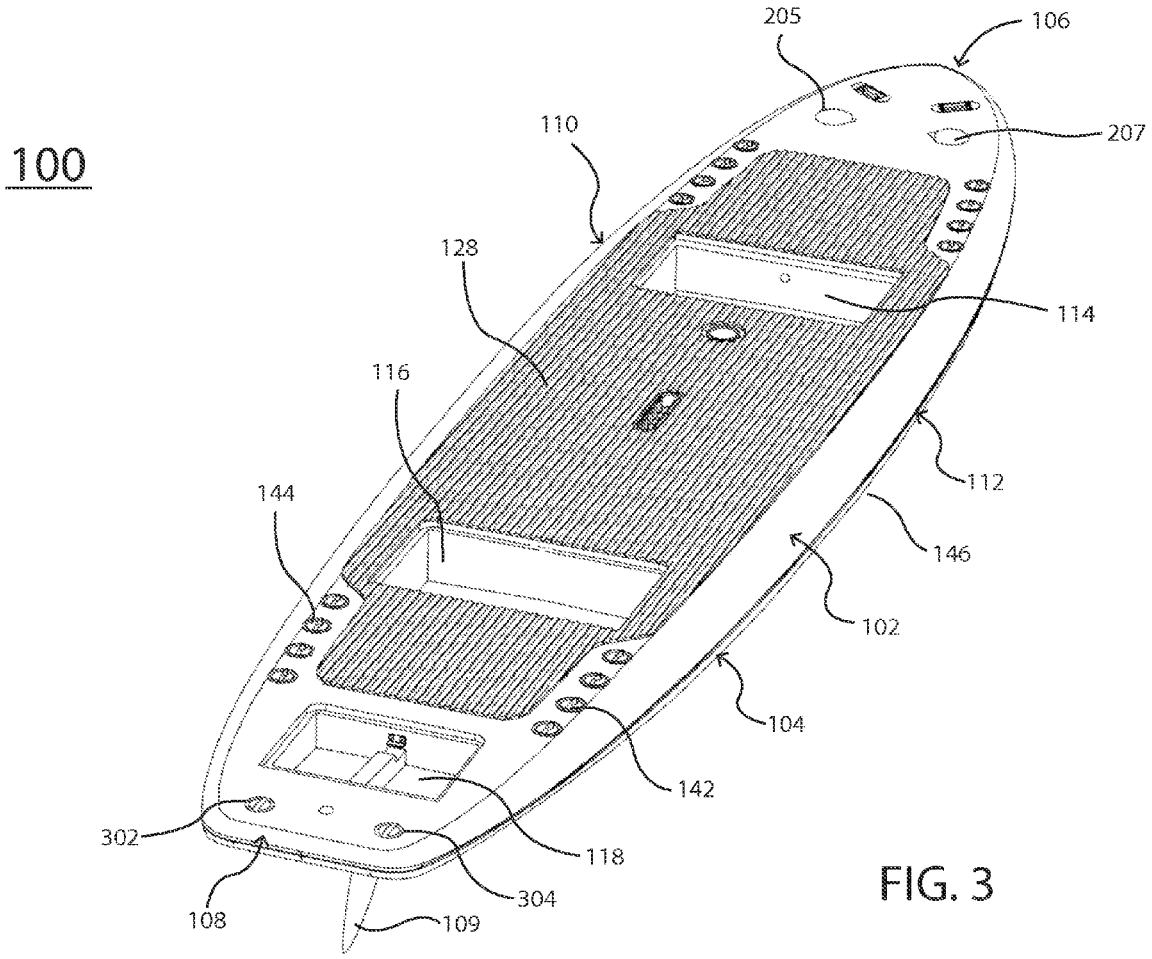
FIG. 3 is a top rear side view of the aquatic sport board of FIG. 1 according to one embodiment of the present invention.

In the example of FIG. 1 these coupling mechanisms 138, 140 are shown situated near the front portion 106 in front of the audio devices 132, 134. However, this is only one non-limiting example of where the coupling mechanisms 138, 140 can be situated. These coupling mechanisms 138, 140 allow the user to couple various items to the board such as, but not limited to, one or more other boards, an anchor, a retaining member such as a cargo net, and the like. Also, one or more retaining/coupling members 142, 144, such as (but not limited) to a cleat, or leash plugs 302, 304 (FIG. 3) can be situated within a cleat receiving area/cavity 141 or a leash plug receiving area/cavity 215, respectively, on the board 100 as well. For example, FIG. 1 shows a plurality of cleats 142, 144 situated around an outside perimeter of the top portion 102 of the board 100. However, these cleats 142, 144 can be located anywhere on the board 100. FIG. 3 shows the leash plugs 302, 304 being disposed between the rear most recessed area 118 and the rear portion 108 of the board 100. One of the leash plugs 302 is disposed towards the first side portion 110 and the other leash plug 304 is disposed towards the second side portion 112, thereby allowing the user to couple a leash to his/her right or left ankle.

The cleats 142, 144 are configured to receive and retain storage components, which allow a user to store and retain items on and/or above the top portion 102 of the board. For example, one or more cargo nets 145 can be secured to the board 100 via the cleats 142, 144. It should be noted that other storage components such as, but not limited to, storage containers can also be coupled to and retained by the cleats 142, 144. In one embodiment, the cleats 142, 144 are removably coupled to a receiving area 141 so that the user can dynamically configure the location of the cleats 142, 144. Also, the cleats 142, 144, in one embodiment, are collapsible/retractable such that at least a portion of the cleats 142, 144 can be dynamically transitioned in and out of board 100. This allows, for example, a user to more easily couple an item to a cleat 142, 144. The user can then retract the cleat 142, 144 such that it is substantially flush with the top portion 102 of the board 100, or partially extends above the top portion 102 of the board 100. The cleats 142, 144 are discussed in greater detail below with respect to FIG. 6.

The board 100, in one embodiment, also comprises one or more illumination devices 146. For example, FIG. 1 shows that a continuous lighting device 146 such as, but not limited to, a rope light that circumscribes an outer perimeter of the board 100 along the first and second side portions 110, 112. However, it should be noted that the one or more illumination devices 146 are not required to be continuous nor are they required to circumscribe an outer perimeter of the board 100. For example, multiple single lights or any other configuration of lights can be situated anywhere on the board 100. The illumination device 146, in one embodiment, is molded between the top portion 102 and the bottom portion 104 of the board 100. However, in another embodiment, the illumination device 146 can "snap-in" around the side portions 110, 112 circumscribing the board 100 for easy removal. In one embodiment, the board 100 comprises lighting systems (and other systems) as required by federal and/or local agencies such as the United States Coast Guard.

FIG. 1 further shows a retaining member 152 that is disposed on the top portion 102 of the board 100. It should be noted that this retaining member 152 can be disposed anywhere on the board. The retaining member 152 is discussed in greater detail below with respect to FIG. 7. FIG. 1 also shows that the board 100, in one embodiment, comprises a retaining area 148 including one or more navigational aids 150. For example, this area 148 can comprise a compass, a clock, a global positioning satellite (GPS) device, etc. In one embodiment, the navigational aid(s) 150 resides within the board 100 and is substantially flush with the top portion 102 of the board 100. The navigational aid(s) 150 can be encapsulated such that it is protected from water. In one embodiment, this area 148 is configured to pivotably retain a navigational aid(s) 150. For example, within this area 148, the navigational aid(s) 150 can be disposed on a pivotable cover (not shown) that swivels/rotates the navigational aid(s) 150 into a cavity 211 (FIG. 2) of the retaining area 148. When rotated into the cavity 211, the cover is substantially flush with the top portion 102 of the board 100. In this orientation, the navigational aid(s) 150 is protected from any hazards, such as water, since the navigational aid(s) 150 is within the cavity 211 and the cover creates a water-tight seal with the top portion 102 of the board 100. The user is then able to pivot/swivel the navigational aid(s) 150 back around for interaction therewith. In another embodiment, the navigational aid(s) 150 is removable and interchangeable as well. The retaining area 148 can also be configured to receive and maintain various mobile devices such as, but not limited to, smart phones, tablet computing devices, cellular phones, media players, etc. It should be noted that the retaining area 148 can be disposed anywhere on the board 100 and is not limited to only comprising navigational aids. The retaining area 148 can comprise various mechanisms to couple an item thereto. For example, hook and loop fasteners, snap fasteners, and the like can be used to couple an item to the receiving area. In addition, an item can be coupled to the receiving area 148 by pressure as well.

In another embodiment, the board 100 also comprises one or more additional recessed areas (not shown) that are configured to retain one or more containers such as, but not limited to, a water bottle, a beverage can, etc. In this embodiment, the one or more additional recessed areas extend from the top portion 102 of the board 100 towards the bottom portion 104 of the board 100. These additional recessed areas, in one embodiment, comprise a retractable member on which a bottom area of a container rests. The retractable member transitions within the recessed area when a container is inserted therein. As the container is removed from the recessed area the retractable member transitions upward towards the top portion 102 of the board 100. When the recessed area is empty (i.e., a container is not inserted therein) the retractable member is substantially flush with the top portion 102 of the board 100. In another embodiment, the recessed areas do not comprises a retractable member and a removable cover can be used to cover the recessed area.

FIG. 2 shows a more detailed exploded view of the board 100 illustrated in FIG. 1. As can be seen in FIG. 2, the board 100 comprises a top portion 102, a bottom portion 104, a front portion 106, a rear portion 108, a first side portion 110, and a second side portion 112. The front portion 106 and rear portion 108 are situated at opposite ends of the board 100 and are coupled to each other via the side portions 110, 112. Each of the top and bottom portions 102, 104 can be made from various materials such as, but not limited to, fiberglass, epoxies, resins, polyurethane foam, wood, composites, and/or the like. In one embodiment, the bottom portion 104 comprises an area 208 for receiving the one or more stabilizing fins 109. However, in another embodiment, the stabilizing fin 109 is molded to the bottom portion 104.

FIG. 2 also shows the one or more recessed areas 114, 116, 118 in more detail. As can be seen from FIG. 2, the one or more recessed areas 114, 116, 118 extend from the top portion 102 inward/downward towards the bottom portion 104 (also shown in FIGS. 3-4) of the board 100. In one embodiment, one or more covering members 120, 122, 124 are removable to provide a dry well for a user as shown in FIG. 3. For example, a user is able to sit on the receiving area(s) 128 and place his/her feet within one or more of the recessed areas 114, 116, 118 (which can positioned anywhere on the board 100) for added comfort and stability. Additionally, one or more of the more recessed areas 114, 116, 118 can be removable so that the user can take the recessed area with him/her for security and/or to use a carrying device. Alternatively, one or more of the more recessed areas 114, 116, 118 can be formed as part of the board 100 as well. Also, one or more of the recessed areas 114, 116, 118 can comprise insulated walls (where the corresponding covering member 120, 122, 124 is also insulated). This allows the recessed areas 114, 116, 118 to act as a cooler. The recessed areas 114, 116, 118, in this example, are also optionally removable so the user can transport the "cooler". In yet another example, one or more of the recessed areas 114, 116, 118 can comprises various docks/ports coupled to a power source 203 and/or the audio devices 132, 134. This devices such as, but not limited to, wireless communication device, media devices such as an MP3 player, computing devices, navigational devices, and the like to be coupled to the power source 203, the audio devices 132, 134, and other components of the board 100.

It should be noted that the recessed areas 114, 116, 118 can also be configured with multiple compartments 204, 206 as shown in FIG. 2 and FIG. 3. For example, FIG. 3 shows that at least one retaining member 118 is divided into two or more sections 204, 206. In one embodiment, the corresponding covering member 124 can also be divided into multiple sections, each section corresponding to at least one section 204, 206 of the retaining member. Each section of the covering member 124 can be independently opened and closed. In another embodiment, the number of sections of the retaining member(s) 118 and/or covering member(s) 124 is configurable by the user. One or more of the recessed areas 114, 116, 118 (or another recessed area not shown) can comprise a housing that secures and waterproofs one or more power sources 203 such as batteries. These batteries can be common non-rechargeable batteries or rechargeable batteries. If rechargeable batteries are used one or more photovoltaic cells can be situated on the top portion 102 of the board 100. The power source(s) 203 can provide power to the audio devices 132, 134 if needed, the illumination devices 146, a user's wireless communication device, media player and/or the like.

In another embodiment, the power source 203 can be electrically coupled to one or more of the cleat receiving areas 141 (FIG. 1) and/or the leash plug receiving area 215 (FIG. 3). This allows various types of electrically accessories to be "plugged" into the board 100. For example, additional illumination devices such as a light pole similar to those used on boats for navigational and safety purposes can be easily "plugged" into a receiving area 141, 215 and illuminated. It should be noted that all of the electrical components of the board 100 are sealed and waterproof such that the board 100 can be submerged in water without being affected.

Figure 4:
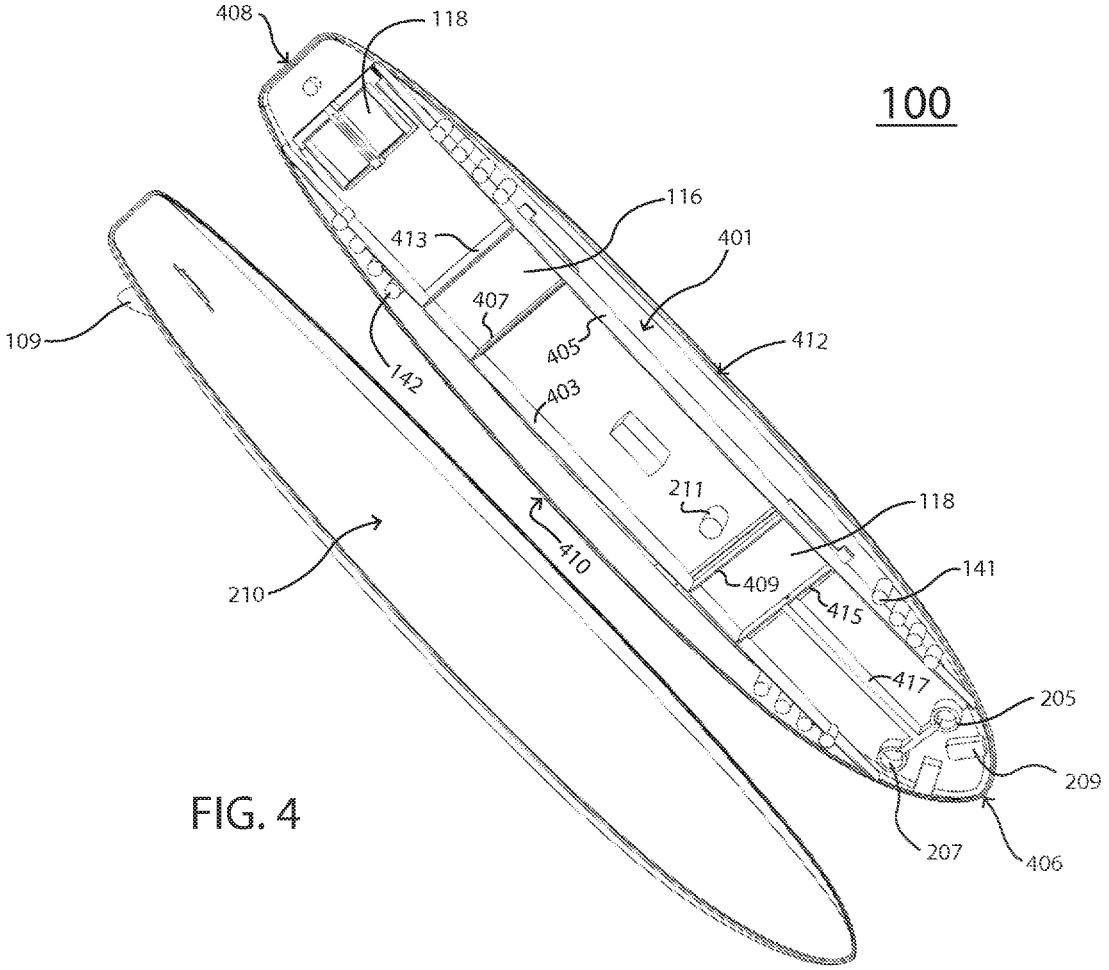
FIG. 4 is an exploded view of the aquatic sport board of FIG. 1 illustrating a bottom view of a top portion of the board and a top view of a bottom portion of the board according to one embodiment of the present invention.

Referring now to FIG. 4, FIG. 4 shows that in one embodiment, a lower portion/underside 401 (the portion facing the bottom portion 104) of the top portion 102 comprises a plurality of optional supporting members 403, 405, 407, 409, that substantially span the length and width of the top portion 102. In one embodiment, at least a first support member 403 is situated towards a first side portion 410 of the board's top portion 102. At least a second support member 405 is situated towards a second side portion 412 of the board's top portion 412 substantially parallel and opposite to the first support member 403. These support members 403, 405 span the length of the board (i.e., front to rear). At least a third support member 407 is situated towards a front portion 406 of the board's top portion 102 substantially perpendicular to the first and second support members 403, 405. At least a fourth support member 409 is situated towards a rear portion 408 of the board's top portion 102 substantially perpendicular to the first and second support members 403, 405 and substantially opposite and parallel to the third support member 407. These support members 407, 409 span the width of the board (i.e., from side to side). In one embodiment, the first and second support members 403, 405 contact the third and fourth support members 407, 409. It should be noted that other configurations of the support members 403, 405, 407, 409 are applicable as well. For example, FIG. 4 shows additional support members 413, 415, 417 disposed between the first, second, third, and fourth support members 403, 405, 407, 409.

The supporting members provide rigidity to the top portion 102 (and bottom portion 104) of the board 100. It should be noted that an upper portion 210 (the portion facing the top portion 102) of the board's bottom portion 104 can similarly comprise supporting members as well. In addition, these optional supporting members 412, 414 can create a bulkhead configuration (sealed compartments/sections) within the inner structure of the board 100. For example, because the third and fourth support members 407, 409 are perpendicular to and contact the first and second support members 403, 405, the space between the third and fourth support members 407, 409 is sealed off from the other portions of the board 100. Therefore, if one section of the board 100 becomes compromised and fills with water, the water is contained within that bulkhead section or compartment, thereby preventing the board 100 from sinking. In one embodiment, the space between the top portion 102 and bottom portion 104 of the board 100 is hollow. In another embodiment, one or more areas between the top portion 102 and bottom portion 104 of the board 100 comprises a buoyant material such as, but not limited to, fiberglass, epoxies, resins, polyurethane foam, wood, composites, and/or the like. In yet another embodiment, a combination of hollow and solid regions exists between the top portion 102 and bottom portion 104 of the board 100.

FIG. 5 shows a more detailed view of the cushion and/or friction providing material 502. In particular, FIG. 5 shows that a heating component 506 is disposed on (or in) one or more areas 504 of a bottom surface 503 of the material 502 between recessed areas 114 and 116. However, the heating component(s) 506 can be disposed anywhere on or within the material 502. It should be noted that the heating component(s) 506 can also be disposed within the top portion 102 of the board 100 as well. The heating component(s) 506 can be battery powered, solar powered, and/or coupled to a power source 203 provided on the board 100. The heating component(s) 506 further comprises one or more activation devices 508 such as a switch (via one or more electrical connections 510) that allows the user to turn on and turn off the heating component(s) 506.

Figure 6:
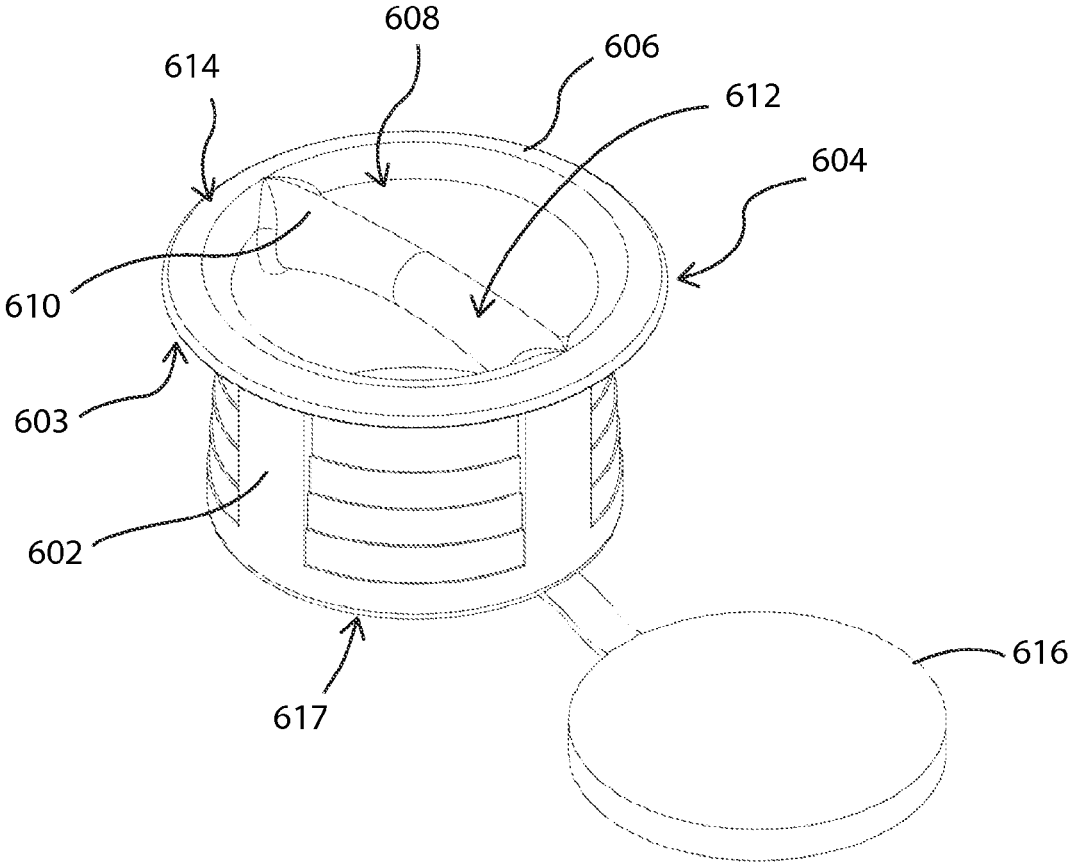
FIG. 6 is a side top view of one example of a coupling member that can be disposed on the aquatic sport board of FIG. 1 according to one embodiment of the present invention.

FIG. 6 shows a more detailed view of a coupling member/cleat 142. In particular, FIG. 6 shows that the cleat 142 comprises a generally cylindrical member 602. The cylindrical member 602 is insertable into a receiving area 141 such as a corresponding cavity within the top portion 102 of the board 100. A first end 604 of the cylindrical member 602 comprises a flanged or annular member 606. This member 606 comprises a diameter that is larger than the diameter of the cylindrical member 602. When the cylindrical member 602 is inserted into a corresponding receiving area 141, a bottom surface 603 of the annular member 606 rests on top of (i.e., contacts) a top surface 103 (FIG. 1) of the top portion 102 of the board 100.

An inner area 608 of the annular member 606 comprises a receiving member 610 that allows various items to be coupled to the cleat 142. The receiving member 610 can be configured to receive various fastening mechanisms such as, but not limited, a hook, a carabineer, rope, snap-in fasteners, and the like. In one embodiment, the receiving member 610 is removable from the annular member 606 and can be interchanged with other receiving members 610. Also, the receiving member 610 can be removed to expose one or more electrical contacts within the cylindrical member 602. This allows one or more components to be "plugged" into the cleat 142 to obtain an electrical connection with a power source 203 (discussed above) residing on the board 100 or to provide a power source to other components.

A top portion 612 of the receiving member 610 can be flush with or extend above a top portion 614 of the annular member 606. In another embodiment, the receiving member 610 is retractable. In this embodiment, a portion (not shown) of the receiving member 610 resides within the cylindrical member 602 when the receiving member 610 is in a retracted position. When in an extended position at least one region of this portion extends above the top portion 614 of the annular member 606.

In one embodiment, an optional annular member 616 is insertable into a bottom portion 617 of the cylindrical member 602. This seals the bottom portion 617 of the cylindrical member 602, thereby preventing any material from entering the cylindrical member 602. In another embodiment, the cylindrical member 602 and the annular member 616 are formed as a single piece and are not separate. It should be noted that other configurations of the cleat 142 than that shown in FIG. 6 are also applicable as well.

Figure 7:
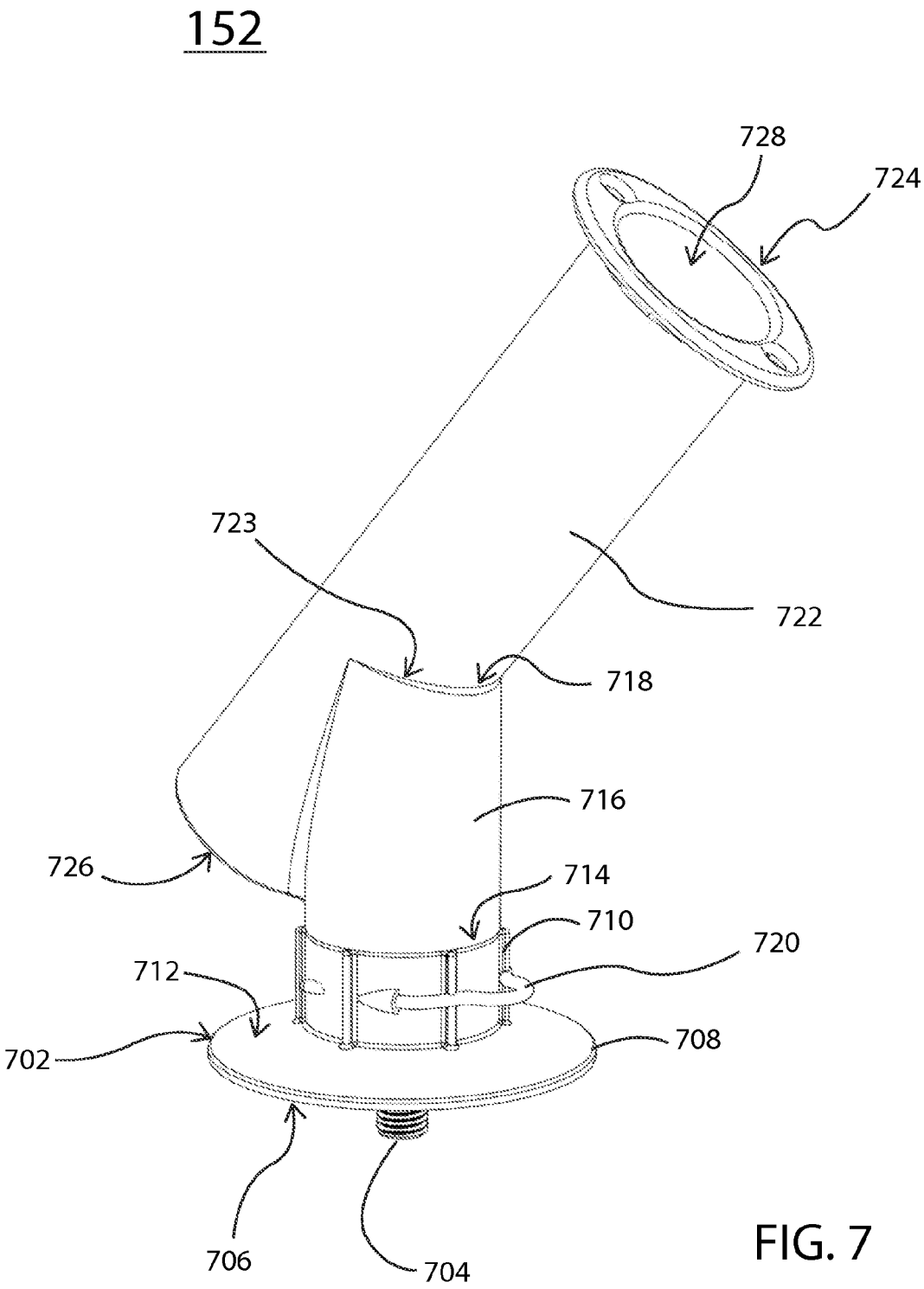
FIG. 7 is a side view of one example of a rotatable retaining member that can be disposed on the aquatic sport board of FIG. 1 according to one embodiment of the present invention.

FIG. 7 shows a more detailed view of the retaining member 152. As shown in FIG. 7, the retaining member 152 comprises a base 702. In one embodiment, the base 702 comprises one or more fastening members 704, such as (but not limited to), a screw, a bolt, a snap fastener, etc., that removably couples the retaining member 152 to the board 100. In another embodiment, at least the base portion 702 of the retaining member 152 can be formed as part of the board 100 as well. The one or more fastening members 704 extend outwards from a bottom surface 706 of the base 702.

The base 102 comprises a first annular member 708 and a second annular member 710. The first annular member 708 comprises a diameter that is larger than a diameter of the second annular member 710. The second annular member 710 extends from a top portion 712 of the first annular member 708. The second annular member 710 comprises a recessed area 714 that is configured to receive a first end (not shown) of a first elongated member 716. The first elongated member 716 also comprises a second end 718 that is opposite the first end. In one embodiment, the first elongated member 716 is removably coupled to the second annular member 710. For example, a locking mechanism 720, such as (but not limited to) a pin, can be used to removably couple the first end of the first elongated member 716 to the second annular member 710. When the pin is inserted into at least the second annular member 710 the first elongated member 706 is fixed/secured to the base 102. When the pin is removed, the first elongated member 716 can be removed from the base 102 and other items can be coupled to the base 102 if desired. It should be noted that other locking mechanism can be used besides that shown in FIG. 7. For example, the first elongated member 716 and the second annular member 710 can comprise threaded members (not shown) that engage each other.

A second elongated member 722 is coupled to the first elongated member 716. In one embodiment, the second elongated member 722 and the first elongated member 716 are coupled to each other at an intersecting angle. The second elongated member 722, in one embodiment, is rotatably/pivotably coupled to the first elongated member 716 by one or more pivot points 723. This allows the second elongated member 722 to pivot about the first elongated member 716. The second elongated member 722 can also be removably coupled to the first elongated member 716. This allows for other items to be coupled to the first elongated member 716 either in a fixed or rotatable fashion. This allows the second elongated member 722 to rotate about the first elongated member 716. In another embodiment, the second annular member 710 is rotatably coupled to the first annular member 708. In this embodiment, the first and second elongated members 716, 722 can be fixably or rotatably coupled to each other. This allows the second annular member 710, the first elongated member 716, and/or the second elongated member 722 to rotate about the first annular member 708.

When the second elongated member 722 is in a non-rotated position with respect to the first elongated member 716, a first end 724 of the second elongated member 722 extends above the second end 718 of the first elongated member 716 and a second end 726 of the second elongated member 722 faces the top portion 102 of the board 100. However, other configurations are applicable as well. In one embodiment, the second elongated member 722 comprises a cavity 728 that extends from the first end 724 of the second elongated member 722 at least partially down towards the second end 726. This allows the first end 724 of the second elongated member 722 to receive items such as, but not limited to, a fishing rod, or any other item. Because the second annular member 710 is rotatably coupled to the first annular member 708 and/or because the first and second elongated members 716, 722 are rotatably coupled to each other, any item retained within the second elongated member 722 can rotate about the board 100 as well.

In another embodiment, the power source 203 discussed above is electrically coupled to the retaining member 152. For example, the second elongated member 722 (or any other portion of the retaining member 152) can comprise one or more electrical contacts that are electrically coupled to the power source 203 via a set of wires that are disposed within the board 100. Therefore, a user is able to electrically couple items into the second elongated member 722 of the retaining member 152 to provide power to the item. Alternatively (or in addition to) a cavity 201 (FIG. 2) that receives a portion of the retaining member 152 to couple the member 152 to the board 100 can also comprise one or more electrical contacts electrically coupled to the power source 203. Therefore, the user can remove the retaining member 152 and electrically couple an item to the cavity 201.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An aquatic sport board for stand-up paddling comprising:

a top portion a majority of the top portion is flat for standing thereupon;

a handle member formed in a substantially center portion of the top portion;

a bottom portion coupled to the top portion by a first side portion and a second side portion, wherein each of the first side portion and the second side portion tapers inward toward a front portion and a rear portion of the top and bottom portions;

a power source;

at least one illuminating device electrically coupled to the power source, the illuminating device circumscribing at least the first side portion and the second side portion;

a first recessed area formed within the top portion extending inwards toward the bottom portion, the first recesses area located in between a front portion and the handle member;

a second recessed area formed within the top portion extending inwards toward the bottom portion located in between a rear portion and the handle member;

at least one speaker is disposed into a waterproof housing formed within a recessed area in the to portion so as to be substantially flush with a surface of the to portion, the recessed area located in between the front portion and the first recessed area;

a first covering member that is disposed over an upper area of the first recessed area, wherein the first covering member creates a waterproof seal with the first recessed area; and a second covering member that is disposed over an upper area of the second recessed area, wherein the second covering member creates a waterproof seal with the second recessed area.

2. The aquatic sport board of claim 1, further comprising:

at least one cavity disposed on an outer perimeter of the top portion, wherein the at least one cavity is configured to receive at least one coupling member.

3. The aquatic sport board of claim 2, further comprising:

at least one of a cargo net and a storage component coupled to the at least one coupling member and to at least one other coupling member situated within at least one other cavity disposed on the outer perimeter of the top portion.

4. The aquatic sport board of claim 1, further comprising:

a plurality of sections situated between the top portion and the bottom portion, wherein each of the sections is sealed off from other sections to prevent passage of a liquid from one section into another section.

5. An aquatic sport board comprising:

a top portion;

a bottom portion coupled to the top portion by a first side portion and a second side portion, wherein each of the first side portion and the second side portion tapers inward toward a front portion and a rear portion of the top and bottom portions;

a power source;

at least one illuminating device electrically coupled to the power source, the illuminating device circumscribing at least the first side portion and the second side portion;

a plurality of recessed areas formed within the top portion extending inwards toward the bottom portion;

at least one covering member that is disposed over an upper area of at least one of the recessed areas, wherein the at least one covering member creates a waterproof seal with the at least one of the recessed areas, and at least one of the recessed areas is sized to accommodate the power source;

at least one retaining member coupled to the top portion, wherein the at least one retaining member comprises:

a base portion coupled to the to portion comprising a first annular member and a second annular member; and at least one elongated member coupled to the base comprising a receiving area extending from a first end of the elongated member towards a second end of the elongated member that is situated opposite from the first end, wherein the base portion comprises:

a first annular member; and a second annular member, wherein the first annular member comprises a diameter that is larger than a diameter of the second annular member;

wherein the second annular member extends from a top portion of the first annular member; and wherein the second annular member is rotatably coupled to the first annular member.

6. The aquatic sport board of claim 5, wherein the at least one elongated member is removably coupled to the base portion and sized to receive a handle of a fishing rod.

7. An aquatic sport board for stand-up paddling comprising:

a to portion a majority of the to portion is flat for standing thereupon;

a bottom portion coupled to the top portion by a first side portion and a second side portion, wherein each of the first side portion and the second side portion, tapers inward toward a front portion and a rear portion of the top and bottom portions;

a plurality of recessed areas formed within the top portion extending inwards toward the bottom portion;

at least one power source disposed in at least one of the recessed areas in the plurality of recessed areas;

at least one speaker the top portion with at least one of an electronic port or an electronic dock for electronically coupling an audio device with the speaker; and at least one illuminating device circumscribing at least the first side portion and the second side portion, wherein the at least one illuminating device is electrically coupled to the power source at least one coupling mechanism situated on the top portion between a first recessed area in the plurality of recessed areas and the front portion;

at least one cavity disposed on an outer perimeter of the top portion, wherein the at least one cavity is configured to receive at least one coupling member;

at least one of a cargo net and a storage component coupled to the at least one coupling member and to at least one other coupling situated within at least one other cavity disposed on the outer perimeter of the top portion;

wherein the at least one of the cushioning material and the friction providing material comprises an electrical heating component coupled to the power source.

8. An aquatic sport board for stand-up paddling comprising:

a to portion a majority of the to portion is flat for standing thereupon;

a bottom portion coupled to the top portion by a first side portion and a second side portion, wherein each of the first side portion and the second side portion, tapers inward toward a front portion and a rear portion of the top and bottom portions;

a plurality of recessed areas formed within the top portion extending inwards toward the bottom portion;

at least one power source disposed in at least one of the recessed areas in the plurality of recessed areas;

at least one speaker the top portion with at least one of an electronic port or an electronic dock for electronically coupling an audio device with the speaker; and at least one illuminating device circumscribing at least the first side portion and the second side portion, wherein the at least one illuminating device is electrically coupled to the power source at least one coupling mechanism situated on the top portion between a first recessed area in the plurality of recessed areas and the front portion;

at least one cavity disposed on an outer perimeter of the top portion, wherein the at least one cavity is configured to receive at least one coupling member; and at least one of a cargo net and a storage component coupled to the at least one coupling member and to at least one other coupling situated within at least one other cavity disposed on the outer perimeter of the top portion;

at least one receiving area disposed on the top portion, the first receiving area comprising at least one of a cushioning material and a friction providing material;

at least one retaining member coupled to the top portion, wherein the at least one retaining member comprises:

a base portion coupled to the to portion comprising a first annular member and a second annular member; and at least one elongated member coupled to the base comprising a receiving area extending from a first end of the elongated member towards a second end of the elongated membered that is situated opposite from the first end;

a first annular member; and a second annular member, wherein the first annular member comprises a diameter that is larger than a diameter of the second annular member, wherein the second annular member extends from a top portion of the first annular member, and wherein the second annular member is rotatably coupled to the first annular member.

9. The aquatic sport board of claim 8, further comprising:

a navigational aid disposed within the top portion.

10. The aquatic sport board of claim 8, further comprising:

a recessed handle that extends from the top portion toward the bottom portion.

11. The aquatic sport board of claim 8, wherein each of the plurality of recessed areas comprises:

at least one covering member that is removably disposed over an upper area of at least one of the recessed areas, wherein the at least one covering member creates a waterproof seal with the at least one of the recessed areas.

12. The aquatic sport board of claim 8, wherein the at least one elongated member is removably coupled to the base portion.

* * * * *